US009914061B2

(12) United States Patent
Cai

(10) Patent No.: US 9,914,061 B2
(45) Date of Patent: Mar. 13, 2018

(54) COMBINED TYPE TOY TOP SEPARATED THROUGH INDUCTION CONTROL

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 0 days.

(21) Appl. No.: 14/916,096

(22) PCT Filed: Jun. 30, 2015

(86) PCT No.: PCT/CN2015/082916
§ 371 (c)(1),
(2) Date: Mar. 2, 2016

(87) PCT Pub. No.: WO2016/119395
PCT Pub. Date: Aug. 4, 2016

(65) Prior Publication Data

US 2017/0319972 A1 Nov. 9, 2017

(30) Foreign Application Priority Data

Jan. 31, 2015 (CN) ..... 2015 1 0049194

(51) Int. Cl.
*A63H 1/18* (2006.01)
*A63H 33/26* (2006.01)
*A63F 9/16* (2006.01)

(52) U.S. Cl.
CPC ..... *A63H 1/18* (2013.01); *A63H 33/26* (2013.01)

(58) Field of Classification Search
CPC ... A63H 1/00; A63H 1/02; A63H 1/06; A63H 1/18; A63H 29/34; A63H 33/26; A63F 9/16
(Continued)

(56) References Cited

U.S. PATENT DOCUMENTS 4,200,283 A * 4/1980 Andrews ..... A63F 9/16 273/108
6,325,690 B1 12/2001 Nelson
(Continued)

FOREIGN PATENT DOCUMENTS

CN 2431025 Y 5/2001
CN 102371071 A 3/2012
(Continued)

OTHER PUBLICATIONS

Russian Search Report for Application No. RU2016108829 dated Mar. 3, 2017.
(Continued)

*Primary Examiner* — Kien Nguyen
(74) *Attorney, Agent, or Firm* — Lerner, David, Littenberg, Krumholz & Mentlik, LLP

(57) ABSTRACT

A combined type toy top separated through induction control, includes a main top, an auxiliary top and an elastic part. When the combined type toy top is in a first state, the main top is limited and fixed by the auxiliary top, above the auxiliary top, and meanwhile the main top compresses the
(Continued)

elastic part so that the elastic part is compressed. The combined type toy top is characterized in that a sensing mechanism is arranged in the auxiliary top. The sensing mechanism can controllably relieve limiting fixation of the main top from the auxiliary top under a second state through induction control. The main top pops up under an elasticity action of the elastic part, and, accordingly, the main top and the auxiliary top rotate independently.

21 Claims, 9 Drawing Sheets

(58) Field of Classification Search
USPC ..... 446/256–264
See application file for complete search history.

(56) References Cited

U.S. PATENT DOCUMENTS

| | | | | |
|---|---|---|---|---|
| 7,037,169 | B2 * | 5/2006 | Benedek | A63H 1/00 446/242 |
| 9,101,845 | B2 * | 8/2015 | Cai | A63H 1/18 |
| 2014/0302743 | A1 | 10/2014 | Cai | |

FOREIGN PATENT DOCUMENTS

| | | | |
|---|---|---|---|
| CN | 203540046 | U | 4/2014 |
| CN | 104174169 | A | 12/2014 |
| CN | 104623900 | A | 5/2015 |
| JP | 2002000962 | A | 1/2002 |
| JP | 2005328976 | A | 12/2005 |
| JP | 2014533594 | A | 12/2014 |
| KR | 20050005664 | A | 1/2005 |
| KR | 20140108664 | A | 9/2014 |
| RU | 2215567 | C1 | 11/2003 |

OTHER PUBLICATIONS

International Search Report for Application No. PCT/CN2015/082916 dated Oct. 29, 2015.

Extended European Search Report for Application No. EP15839135.9 dated Aug. 28, 2017.

* cited by examiner

COMBINED TYPE TOY TOP SEPARATED THROUGH INDUCTION CONTROL

CROSS-REFERENCE TO RELATED APPLICATIONS

The present application is a national phase entry under 35 U.S.C § 371 of International Application No. PCT/CN2015/082916 filed Jun. 30, 2015, which claims priority from Chinese Application No. 201510049194.9 filed Jan. 31, 2015, all of which are hereby incorporated herein by reference.

TECHNICAL FIELD

The invention relates to a toy top, and particularly to a combined type toy top separated through induction control.

BACKGROUND

An existing toy top basically is composed of a single top, including: a shaft sleeve body, a top cover, a top slice and a top top. A top launcher is connected with the top cover to implement that the top is launched to rotate. In order to increase or improve the performance of the top to win a competitor in a competition, for the most part the existing toy top is designed to be assembled and intensified, the top is designed to be a connection manner which is easily disassembled and assembled, and the shaft sleeve body is designed to be additionally equipped and lengthened, so that the top may be disassembled easily and quickly to replace or add accessories. However, no matter how it is modified and intensified, the toy top only rotates and competes in the competition process with one top, thus it is difficult to greatly improve the win rate, and a demountable toy top is very widespread. Therefore, players gradually lose sense of curiosity to such a toy top, and the top can hardly gain the favor of players in the long run.

An existing separable combined type toy top resorts to continually hitting against a competitor's top in a competition process to relieve a clamping connection of a main top from an auxiliary top so that the main top is popped out and thus the toy top is separated into two tops to attack the competitor's top. However, relieving the clamping connection by means of collision has greater uncertainty. Perhaps the competition is over but the combined type top is not separated into two tops yet. For this reason, the existing separable combined type toy top lack of controllability and is unable to be separated as players wish.

SUMMARY

In allusion to the problems in the prior art, the object of the invention is to provide a combined type toy top separated through induction control which can control tops to separate in the playing process without affecting rotation of the tops.

In order to achieve the above-mentioned object, the invention adopts such a technical scheme as below: a combined type toy top separated through induction control, including: a main top, an auxiliary top and an elastic part, where when the combined type toy top is in a first state, the main top is limited and fixed, by the auxiliary top, above the auxiliary top, and meanwhile the main top compresses the elastic part so that the elastic part is compressed; the combined type toy top is characterized in that a sensing mechanism is arranged in the auxiliary top, the sensing mechanism can controllably relieve limiting fixation of the main top from the auxiliary top under a second state through induction control, the main top pops up under an elasticity action of the elastic part, and accordingly the main top and the auxiliary top rotate independently.

In the invention, the limiting fixation may be that the main top rotates and is clamped and connected above the auxiliary top, meanwhile the auxiliary top further includes a connecting piece used to clamp and connect with the main top, in the second state, the sensing mechanism is triggered by induction to drive the connecting piece to rotate, and the main top relieves the clamping and connecting status after the rotation of the connecting piece. The limiting fixation may also be that a shotpin is inserted into the main top so that the main top is fixed above the auxiliary top, meanwhile the auxiliary top further includes a solenoid valve used to drive the shotpin to move, in the second state, the sensing mechanism is triggered by induction so that the solenoid valve drives the shotpin to move, and the main top relieves the limiting fixation after the shotpin moves. Of course, other manners of limiting fixation are also permissible, for example, the main top jacks up to relieve the limiting fixation, etc.

The sensing mechanism of the invention includes: an inductor inducting an outside inductive source, a motor driving the connecting piece to rotate and a power source supplying power for the motor. Circuits of the motor and of the power source are interconnected when the inductor receives an induction from the outside inductive source, at the moment the motor works and drives the connecting piece to rotate, and further relives the clamping connection of the main top so that the main top pops up under the elasticity action of the elastic part, and accordingly the main top and the auxiliary top rotate independently. The sensing mechanism also may be an inductive moving part that can move after being induced by the outside inductive source, the inductive moving part is clamped and connected with the connecting piece, after receiving the induction of the outside inductive source, the inductive moving part moves and relieves the clamping connection of the connecting piece to make the connecting piece rotate and relieve the clamping connection of the main top so that the main top pops up under the elasticity action of the elastic part, and accordingly the main top and the auxiliary top rotate independently.

The inductor may be an inductive switch connected in series with the motor and the power source, the inductive switch is switched on when it receives the induction from the outside inductive source, the circuits of the motor and of the power source are interconnected, and the power source supplies power for the motor to make it work. The inductor also may be an inductive circuit connected with an electric control switch connected in series with the motor and the power source, when the inductive circuit receives the induction from the outside inductive source, the inductive circuit sends a signal to switch on the electric control switch, the circuits of the motor and of the power source are interconnected, so that the power source supplies power for the motor to make it work.

Meanwhile, manners of induction of the inductor may be diversified. For example, the inductor is a photosensitive inductor, a magnetic control inductor, a heat-sensitive inductor or a sound control inductor.

The inductive circuit and the circuits of the motor and of the power source are integrated on a circuit board, the circuit board is mounted at an edge-adjoining position inside the auxiliary top, the motor is mounted in a middle position inside the auxiliary top, and the power source is mounted aside the motor.

The inductive circuit is a photosensitive inductive circuit, a magnetic control inductive circuit, a heat-sensitive inductive circuit or a sound control inductive circuit, the one or more different inductive circuits and the circuits of the motor and of the power source are integrated on the same circuit board, and when multiple inductive circuits are integrated on the circuit board, each of the inductive circuits may separately control the electric control switch to switch on. Therefore, it is implemented that various manners of induction may be used to control one toy top.

Further, the inductor is a magnetic control inductive circuit, and the magnetic control inductive circuit includes an IC chip and a magnetic control switch, when the magnetic control switch receives a magnetic induction from the outside inductive source, the magnetic control switch is switched on to make the circuits be interconnected, and when it is detected that the magnetic control switch is switched on, the IC chip sends a control signal to control the motor to work.

In order that the toy top is compact in structure and the connecting piece is intermittent in rotation, the motor is arranged below the connecting piece in an accumbent manner, an end of a rotating shaft of the motor is connected with a toggle piece, when the motor is working, the rotating shaft rotates and drives the toggle piece to rotate, and the toggle piece rotates and drives the connecting piece to rotate to relieve the clamping connection of the main top.

In order to reduce the rotational speed of the connecting piece to ensure that sufficient time is provided for separating the main top, between the motor and the toggle piece there is provided with a planetary gear, one end of the planetary gear is connected with the rotating shaft of the motor, and the other end is connected with the toggle piece. A transmission ratio is reduced by means of the planetary gear.

In order to further reduce energy consumption and prolong the service life of the sensing mechanism, the auxiliary top is further provided with an automatic stop detection device, in the second state, when it is detected that the limiting fixation of the main top by the auxiliary top is relieved, the automatic stop detection device controls the sensing mechanism to disconnect the induction control.

In order to ensure that when the connecting piece is driven by the motor to rotate, the main top does not rotate accordingly due to clamping connection friction thereby avoiding failure of relieving the clamping connection for implementing separation, an upper surface of the upper top holder is provided with a socket recess, a bottom of a top holder of the main top is correspondingly provided with a docking ring, a position of the docking ring corresponding to the socket recess is provided with a socket convex that mates with the socket recess, when the main top is clamped and connected with the auxiliary top, the socket convex of the docking ring is socketed into the socket recess of the upper top holder; in this way, it is implemented that driven by the motor, the connecting piece may rotate relative to the main top to relieve the clamping connection of the main top.

Further, in order that when the main top is docked with the auxiliary top, it is implemented that the connecting piece is automatically clamped and connected with the main top, the connecting piece may be rotatably mounted in the middle of the mounting base of the auxiliary top, a middle of the connecting piece is provided with a splined clamping and connecting hole, a side wall at an upper edge of the clamping and connecting hole is provided with an incised bevel edge, the connecting piece is provided with a return spring to make the connecting piece reverse to return after a rotation, a top top holder of the main top is correspondingly provided with a splined clamping lug; when the socket convex is aligned to the socket recess and a malposition exists between the clamping lug and the clamping and connecting hole, the main top is downward inserted into the auxiliary top, in this process, the clamping lug squeezes the incised bevel edge and generates a component force to make the connecting piece rotate so that the clamping lug is clamped into the clamping and connecting hole, after which, under the action of the return spring, the connecting piece reverses to return so that the clamping lug is clamped into the clamping and connecting hole, in this way, the main top and the auxiliary top are combined into a whole.

In the combined type toy top of the invention, a sensing mechanism is arranged in the auxiliary top, the sensing mechanism can controllably relieve limiting fixation of the main top from the auxiliary top when the sensing mechanism is under an induction control so that the combined type toy top is changed from the first state to the second state, namely, the main top pops up under the elasticity action of the elastic part, and accordingly the main top and the auxiliary top rotate independently. Thus, players can separate the tops through induction at will; meanwhile, because of inductive separation, rotation of the toy top is not influenced, thus, in the whole competition process, the toy top is high in controllability, high in operability, novel in playing method, and higher in interestingness, the top is divided into two parts, attack force of tops on one's own side is greatly increased, the win rate is higher, and thus the top can gain the favor of more players. The inductor may be a low-end inductive moving part, or a medium-end inductive switch, or a high-end inductive circuit. Therefore, toy tops having the same functions but different prices may be manufactured to meet different consumers' demands. For another reason, one or more inductive circuits may be integrated on one circuit board, and when multiple inductive circuits are integrated on the same circuit board, each of the inductive circuits may separately control the motor to work. Therefore, it is implemented that different manners of induction may be used to trigger the separation of one toy top, the playing methods are diversified, and the controllability and the interestingness of the toy top may be further improved. The motor is provided with an automatic stop detection device, after the connecting piece rotates and relieves the clamping connection of the main top, two contact pins of the automatic stop detection device exactly are out of contact with the metal block so that the motor is controlled to stop. This design may save power consumption of the power source and make the service life of the power source longer. The main top is directly downward inserted into the auxiliary top so that the connecting piece is squeezed and rotated and then reverses to return, in this way, it is implemented that the main top is clamped and connected. After the main top is clamped and connected with the auxiliary top, they are fixed. Therefore, it is ensured that the main top is not driven to rotate when the connecting piece is driven by the motor to rotate, thereby a separation success rate is increased. In addition, the performance of the toy top may be improved as the main top and the auxiliary top are fixed. The combined type toy top separated through induction control of the invention is so designed slickly that it solves the problem that an existing separable toy top is unable to be subjected to autonomous control, so that players have higher control power in the competition to improve the interestingness and initiative in the game, and achieve the objectives of cultivating children's ability of operation, ability of judgment and ability of competition, etc.

The following further describes the present invention with reference to the accompanying drawings and embodiments.

DETAILED DESCRIPTION OF THE EMBODIMENTS

Figure 1:
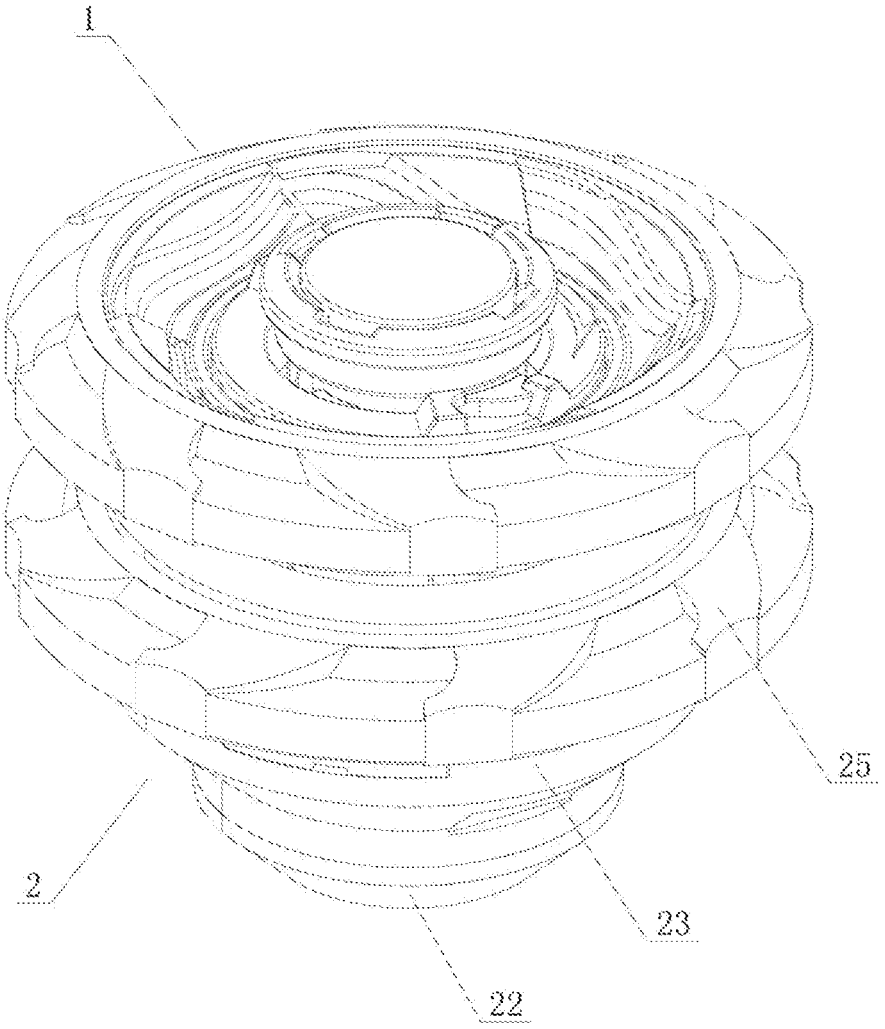
FIG. 1 is a tridimensional schematic structural diagram of the present invention.

As shown in FIGS. 1-11, a combined type toy top separated through induction control according this embodiment includes: a main top 1, an auxiliary top 2 and an elastic part 3. When the combined type toy top is in a first state, the main top 1 rotates and is limited and fixed above the auxiliary top 2, and meanwhile the main top 1 compresses the elastic part 3 so that the elastic part 3 is compressed. The auxiliary top 2 is internally provided with a sensing mechanism 4 and a connecting piece 5 used for clamping and connecting the main top 1, when the sensing mechanism 4 receives an induction control from the outside inductive source, the sensing mechanism 4 is triggered to drive the connecting piece 5 to rotate, the sensing mechanism 4 can controllably relieve limiting fixation of the main top 1 from the auxiliary top 2 under a second state, the main top 1 pops up under the elasticity action of the elastic part 3, and accordingly the main top 1 and the auxiliary top 2 rotate independently. Thus, players can bring the toy top close to the outside inductive source to separate the tops at will; meanwhile, because of inductive separation, rotation of the toy top is not influenced, in the whole competition process, the toy top is high in controllability, high in operability, novel in playing method, and higher in interestingness, the top is divided into two parts, attack force of tops on one's own side is greatly increased, the win rate is higher, and thus the top can gain the favor of more players.

Embodiment I

Figure 2:
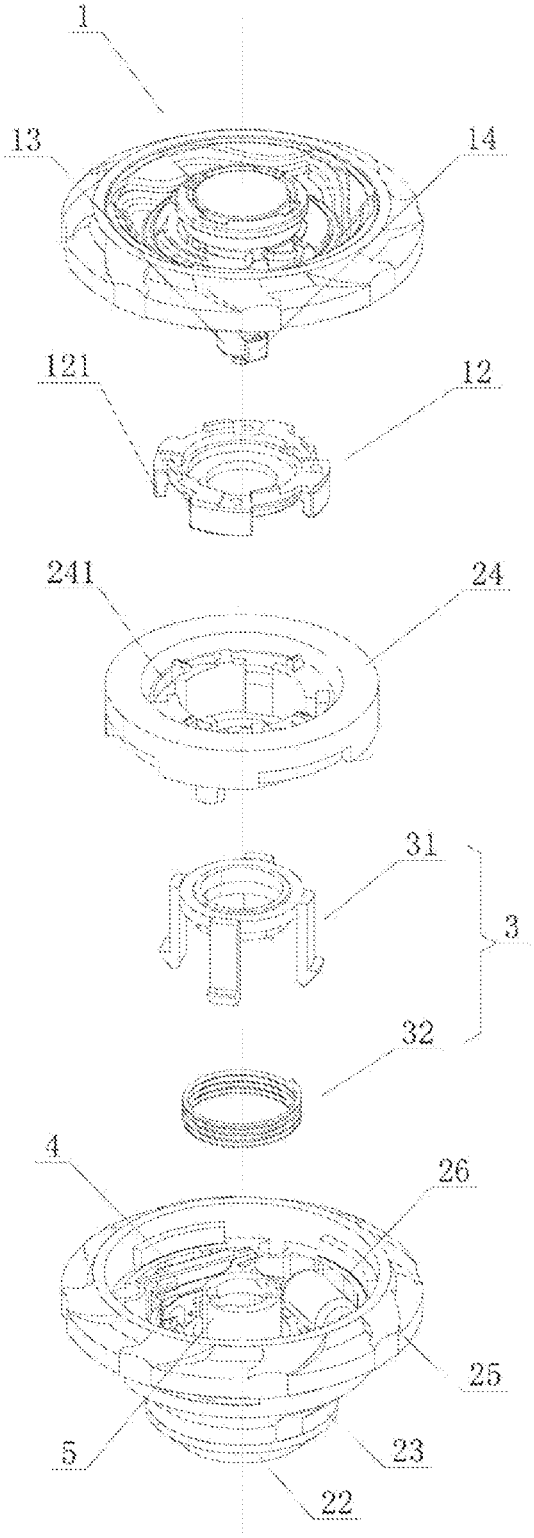
FIG. 2 is a schematic structural breakdown diagram of the present invention.
Figure 3:
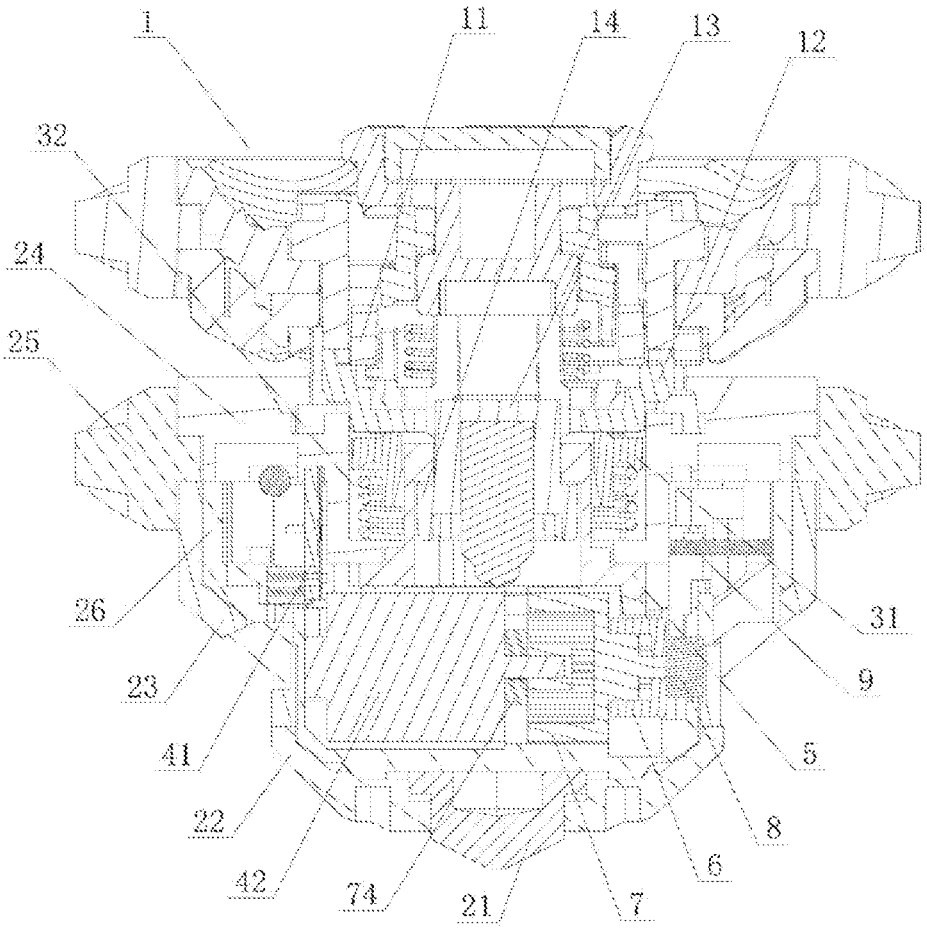
FIG. 3 is a schematic structural sectional view of the present invention.
Figure 4:
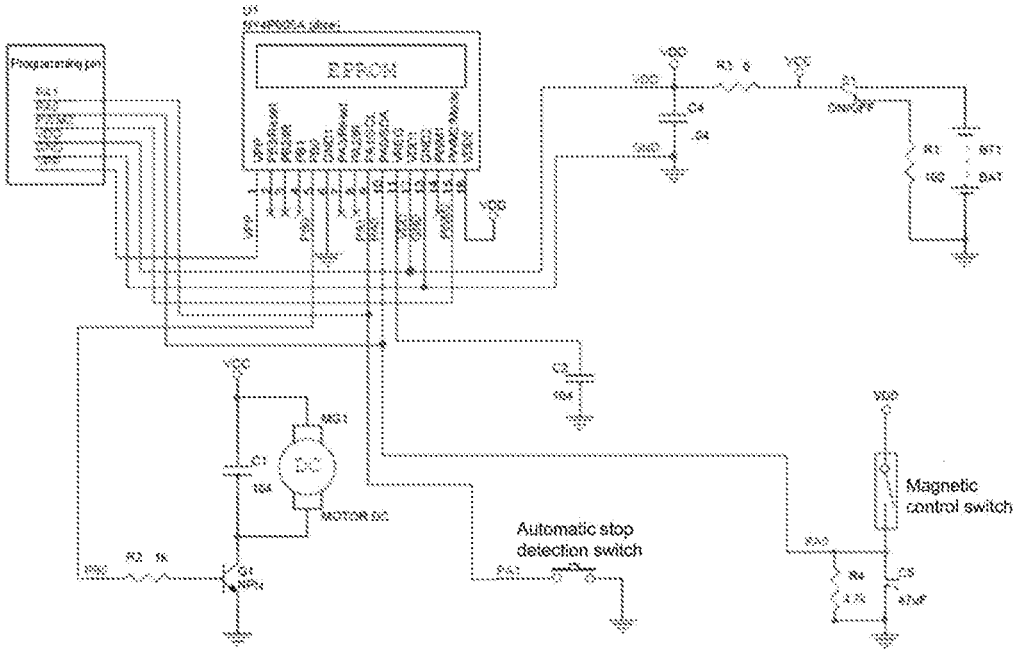
FIG. 4 is a schematic circuit diagram of the magnetic control inductive circuit of the present invention.
Figure 6:
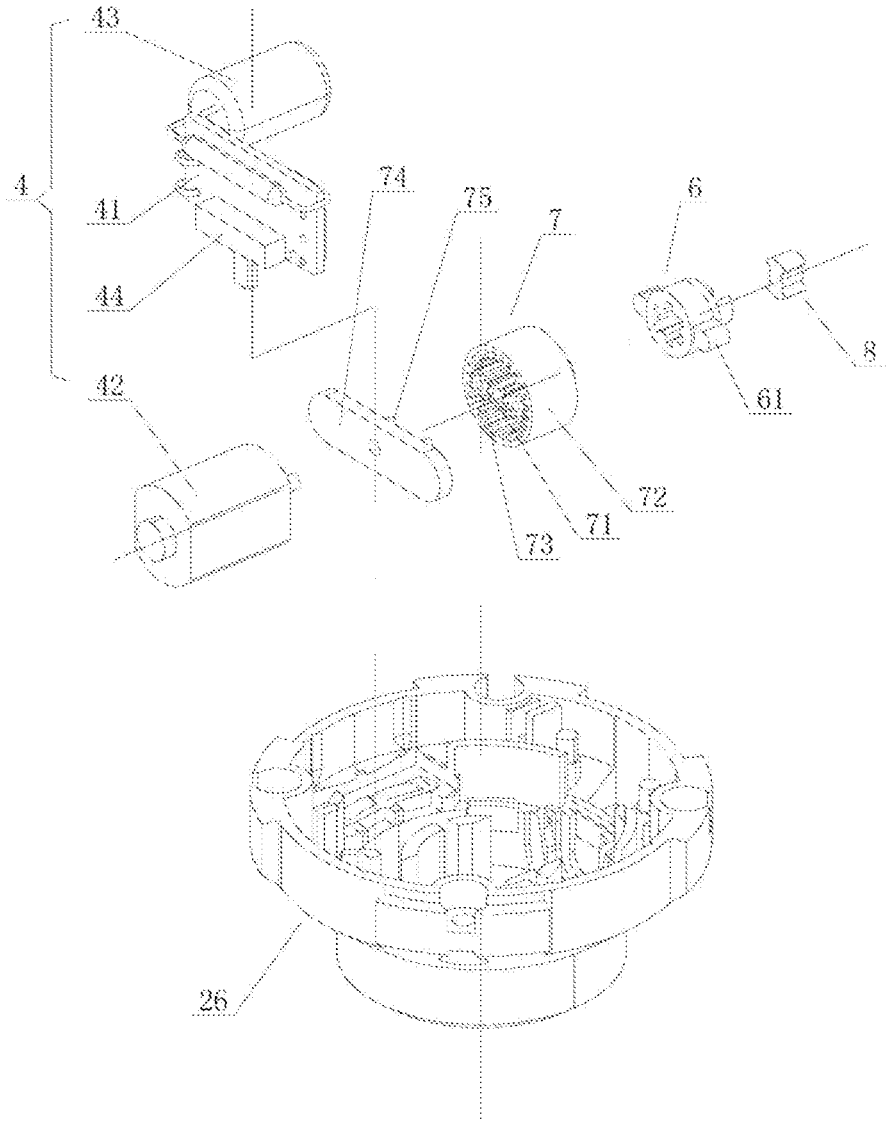
FIG. 6 is a schematic structural breakdown diagram of the sensing mechanism of the present invention.

As shown in FIG. 2 or 3, the sensing mechanism 4 of this embodiment includes an inductor inducting an outside inductive source, a motor 42 driving the connecting piece 5 to rotate and a power source 43 supplying power for the motor 42. Circuits of the motor 42 and of the power source 43 are interconnected when the inductor receives an induction from the outside inductive source, at the moment the motor 42 works and drives the connecting piece 5 to rotate, and further relives the clamping connection of the main top 1 so that the main top 1 pops up under the elasticity action of the elastic part 3. In this embodiment, the sensing mechanism 4 is a magnetic control inductive circuit, as shown in FIG. 4, the magnetic control inductive circuit consists of an EPROM, a magnetic control switch, a C5 and a R4. In addition, the circuit of the motor consists of a DC motor, a C1, a Q1 and an R2. The circuit of the power source consists of a BAT, a switch S1, a C4, an R1 and an R3. The outside inductive source in this embodiment corresponds to a sensor bar whose end is provided with a magnet. When the magnet at the end of the sensor bar gets close to the rotating toy top, the magnetic control switch in the magnetic control inductive circuit is attracted by magnetic force of the magnet and thus is switched on so that the inductive circuit is interconnected. The magnetic control inductive circuit sends a signal to a PA0 pin of the EPROM. After receiving the signal, the EPROM controls the motor 42 in the motor circuit to work by means of a PB0 pin. As shown in FIG. 6, the foregoing circuits are integrated on the same circuit board 41 on which a power source control switch 44 is disposed, the power source control switch 44 corresponds to S1 in the circuit of the power source, the circuit board 41 is mounted at an edge-adjoining position inside the auxiliary top 2, the motor 42 is mounted in a middle position inside the auxiliary top 2, and the power source 43 is mounted aside the motor 42.

Figure 5:
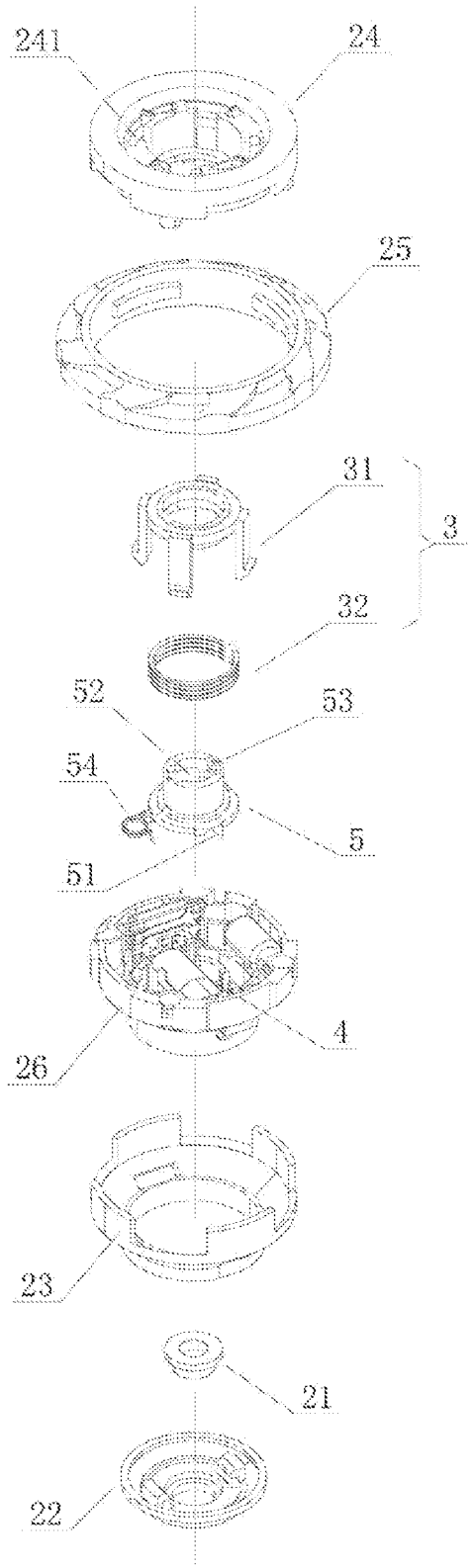
FIG. 5 is a schematic structural breakdown diagram of the auxiliary top of the present invention.
Figure 7:
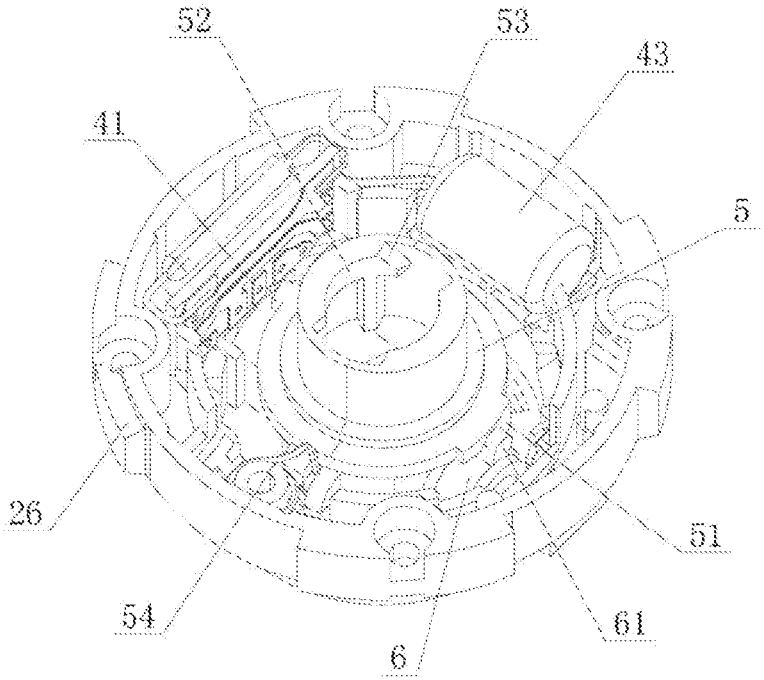
FIG. 7 is a schematic internal structural diagram showing the connecting piece of the present invention is in a clamping and connecting status.
Figure 8:
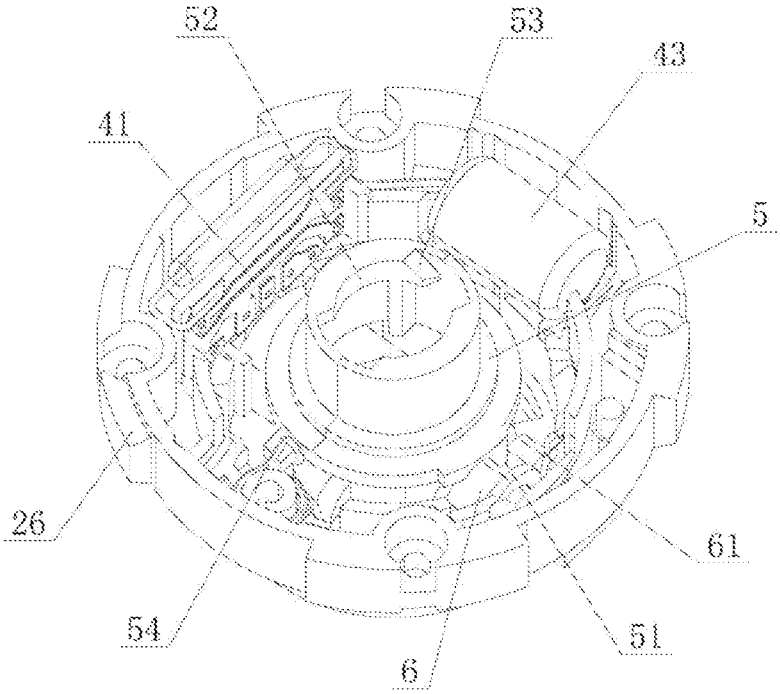
FIG. 8 is a schematic internal structural diagram showing the connecting piece of the present invention is relieved from the clamping and connecting status.
Figure 9:
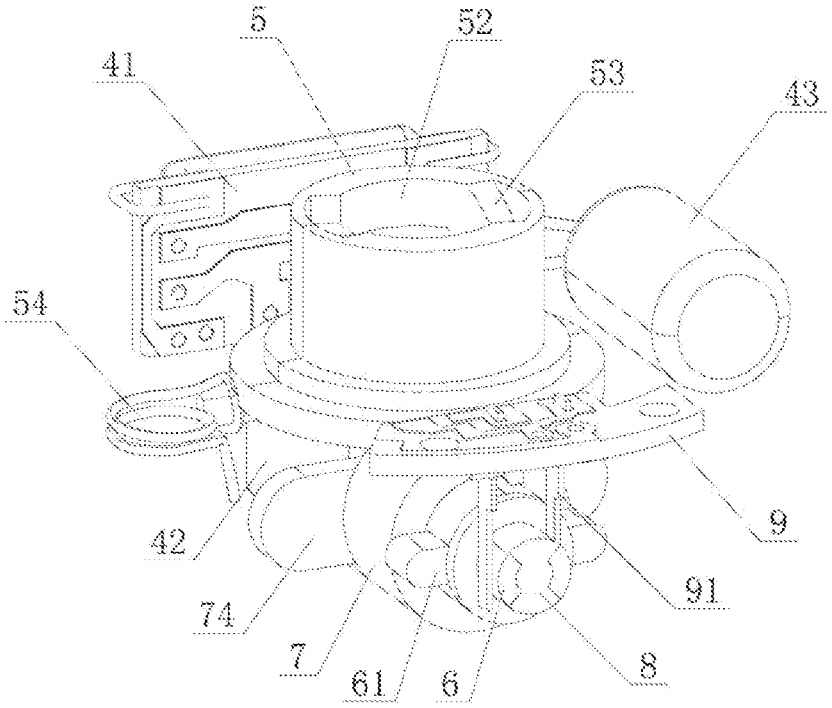
FIG. 9 is a tridimensional schematic structural diagram showing the automatic stop detection device of the present invention is not in contact with a metal block.
Figure 10:
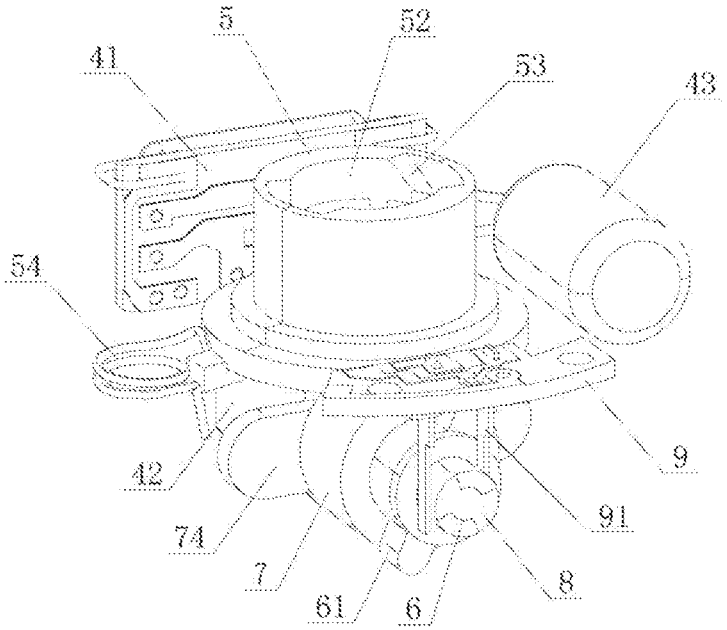
FIG. 10 is a tridimensional schematic structural diagram showing the automatic stop detection device of the present invention is in contact with the metal block.

As shown in FIG. 5, in this embodiment, the elastic part 3 is disposed in the auxiliary top 2, the elastic part 3 includes a spring 32 and a pop-up seat 31, the spring 32 is sleeved outside the connecting piece 5, and the pop-up seat 31 is mounted above the spring 32. When the main top 1 is clamped and connected with the connecting piece 5, the spring 32 and the pop-up seat 31 are squeezed down. When the main top 1 is relieved from the clamping and connecting status after the connecting piece 5 rotates, the pop-up seat 31 moves up under the elasticity action of the spring 32, and meanwhile the main top 1 is popped out. In this embodiment, the auxiliary top 2 includes a top top 21, a top top holder 22, a lower top holder 23, an upper top holder 24, a top slice 25 and a mounting base 26, where the sensing mechanism 4 is mounted and fixed inside the mounting base 26, the mounting base 26 is fixed between the lower top holder 23 and the upper top holder 24, the pop-up seat 31 may be mounted, in a manner of moving up and down, between the upper top holder 24 and the mounting base 26, the pop-up seat 31 may move up to stretch out of the upper top holder 24 and is limited by the upper top holder 24 lest the pop-up seat 31 should break away from the auxiliary top 2, and the top slice 25 is sleeved between the upper top holder 24 and the mounting base 26. As shown in FIG. 6, in this embodiment, the motor 42 is arranged below the connecting piece 5 in an accumbent manner, an end of a rotating shaft of the motor 42 is connected with a toggle piece 6, the toggle piece 6 is a cylinder, and either of two symmetrical sides of the cylinder is provided with a lug 61. A convex edge 51 is disposed in a position, at a bottom edge of the connecting piece 5, corresponding to the toggle piece 6. Driven by the rotating shaft of the motor 42, the lug 61 of the toggle piece 6 rotates to the convex edge 51 of the connecting piece 5, and drives the connecting piece 5 to rotate to relieve the clamping connection of the main top 1. FIG. 7 shows that the connecting piece 5 is driven by the toggle piece 6 to rotate until the main top 1 is relieved from the clamping and connecting status. The connecting piece 5 is provided with a return spring 54 to make the connecting piece 5 reverse to return after a rotation. After the toggle piece 6 continues rotating, the lug 61 gradually gets away from the convex edge 51. After the lug 61 gets away from the convex edge 51, under the elasticity action of the return spring 54, the connecting piece 5 reverses to return its initial position, as shown in FIG. 8, so that the other lug 61 of the toggle piece 6 again drives the connecting piece 5 to rotate. In this embodiment, between the motor 42 and the toggle piece 6 there is provided with a planetary gear 7, a sun gear 71 of the planetary gear 7 is connected with the rotating shaft of the motor 42, and an outer gear ring 72 is connected with the toggle piece 6. An external end face of the outer gear ring 72 is integratively provided with a gear, a docking end of the toggle piece 6 is correspondingly provided with an inner gear hole meshing with the gear. Between the motor 42 and the planetary gear 7 there is also provided with a fixed plate 74 on which two shaft columns 75 are disposed to connect two planetary pinions 73 of the planetary gear 7 so that power is inputted from the sun gear 71 and outputted from the outer gear ring 72. In this way, the transmission ratio is reduced so that the toggle piece 6 rotates slowly, and further the rotational speed of the connecting piece 5 is reduced to ensure that that sufficient time is provided for separating the main top 1. As shown in FIGS. 9 and 10, in this embodiment, a front end of the toggle piece 6 is provided with a metal block 8, in a position above the metal block 8 there is provided with an automatic stop detection device 9 mounted in the auxiliary top 2, and correspondingly a detection circuit is disposed on a circuit board. As shown in FIG. 4, the detection circuit includes an automatic stop detection switch, one end of which is grounded and the other end is connected to an EPROM PA1 pin, the automatic stop detection device 9 extends downward two contact pins 91 respectively located at two sides of the metal block 8. In the process when the metal block 8 rotates with the toggle piece 6, the metal block 8 may be out of contact with the two contact pins 91, in this case, the automatic stop detection switch in the circuit is switched off. When it is detected that the switch is switched off, the EPROM sends a control signal to control the motor 42 to stop working so as to reduce unnecessary power loss of the power source 43, in the status as shown in FIG. 9. In the process when the toggle piece 6 drives the connecting piece 5 to rotate, the metal block 8 is exactly in contact with the two contact pins 91, in the status as shown in FIG. 10.

Figure 11:
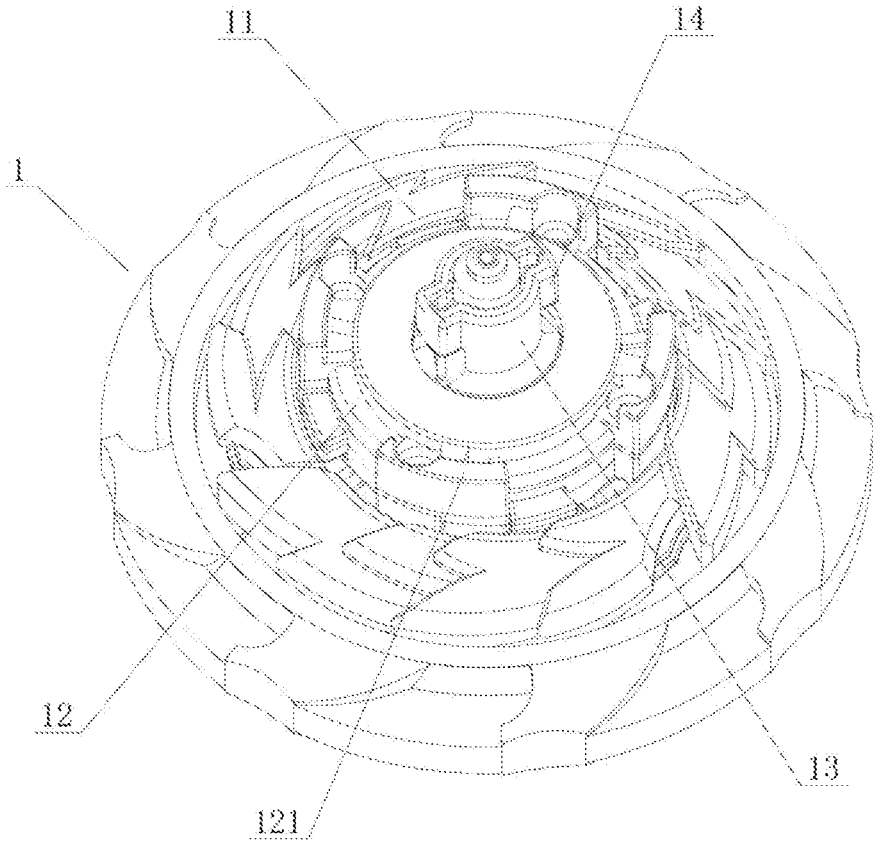
FIG. 11 is a tridimensional schematic structural diagram showing the top top of the main top of the present invention is upturned.

As shown in FIG. 2, in this embodiment, an upper surface of the upper top holder 24 is provided with a socket recess 241, a bottom of a top holder 11 of the main top 1 is correspondingly provided with a docking ring 12, a position of the docking ring 12 corresponding to the socket recess 241 is provided with a socket convex 121 that mates with the socket recess 241, and the docking ring 12 and the main top 1 are connected and fixed by means of a bolt, as shown in FIG. 11. When the main top 1 is clamped and connected with the auxiliary top 2, the socket convex 121 of the docking ring 12 is socketed into the socket recess 241 of the upper top holder 24, as shown in FIG. 4. In this way, it is ensured that when the connecting piece 5 is driven by the motor 42 to rotate, the main top 1 does not rotate accordingly due to clamping connection friction thereby avoiding failure of relieving the clamping connection for implementing separation. In this embodiment, a middle of the connecting piece 5 is provided with a splined clamping and connecting hole 52, a side wall at an upper edge of the clamping and connecting hole 52 is provided with an incised bevel edge 53, as shown in FIG. 11, a top top holder 13 of the main top 1 is correspondingly provided with a splined clamping lug 14. When the socket convex 121 is aligned to the socket recess 241 and a malposition exists between the clamping lug 14 and the clamping and connecting hole 52, the main top 1 is downward inserted into the auxiliary top 2, in this process, the clamping lug 14 first squeezes the incised bevel edge 53 and generates a component force to make the connecting piece 5 rotate so that the clamping lug 14 is clamped into the clamping and connecting hole 52 when the connecting piece 5 rotates until the clamping and connecting hole 52 is aligned to the clamping lug 14, after which, under the action of the return spring 54, the connecting piece 5 automatically reverses to return so that the clamping lug 14 is clamped into the clamping and connecting hole 52, in this way, the main top 1 and the auxiliary top 2 are combined into a whole, as shown in FIG. 3.

Embodiment II

In this embodiment, the sensing mechanism 4 also includes an inductor inducting an outside inductive source, a motor 42 driving the connecting piece 5 to rotate and a power source 43 supplying power for the motor 42. What is different is that in this embodiment, the sensing mechanism 4 is an infrared induction circuit, and the circuit board 41 is provided with an infrared receiver. The main top 1 and the auxiliary top 2 in this embodiment are the same as those in Embodiment I, the only difference is that a position of the auxiliary top 2 corresponding to the infrared receiver is provided with an orifice so that outside infrared may irradiate on the infrared receiver. Correspondingly, in this embodiment, an end of the outside inductive source is provided with a sensor bar of an infrared lamp, and the sensor bar is provided with a lamp button. The difference between the circuits in this embodiment and the circuits in Embodiment I resides in the inductive circuit, namely, the magnetic control inductive circuit is changed into an infrared induction circuit. In the playing process, the infrared lamp is turned on, and infrared is aligned to the rotating auxiliary top 2. When infrared enters into the orifice of the auxiliary top 2, the infrared receiver may receive the infrared, and also sends a signal to the IC chip, and then the IC chip sends a control signal to control the motor to work.

The combined type toy top of the invention can be used in a top competition. When the top is designed, diversified main tops 1 and auxiliary tops 2 having different attack abilities may be designed and assembled. Then the power source control switch 44 is switched on. After a game is started, players launch their tops to an arena to hit against each other. According to their own judgments, the players may bring the sensor bar close to the rotating auxiliary top 2 so that the inductive circuits are interconnected, the motor 42 works and drives the connecting piece 5 to rotate and relieve the clamping connection of the main top 1, at the moment the main top 1 pops up under the action of the spring seat 31 and the spring 32, then breaks away from the auxiliary top 2 under the action of rotational inertia thereof, and finally lands and continues rotating. Whereas the auxiliary top 2 can still continue rotating after the main top 1 is popped out. Namely, the combined type top is separated into two separately independent tops to rotate, thereby forming a competitive situation of two against one, which greatly improves the win rate, increases the controllability and interestingness of the toy top in a competition, and cultivates children's ability of operation, ability of judgment and ability of competition, etc.

Although the present invention is described by reference to embodiments, the description does not signify to limit the present invention. By reference to the description of the present invention, other variations of the embodiments disclosed are expectable for those skilled in the art, and these variations shall fall within the scope limited by the claims.

The invention claimed is:

1. A combined type toy top separated through induction control, comprising: a main top, an auxiliary top and an elastic part, wherein when the combined type toy top is in a first state, the main top is limited and fixed, by the auxiliary top, above the auxiliary top, and meanwhile the main top compresses the elastic part so that the elastic part is compressed; the combined type toy top is characterized in that a sensing mechanism is arranged in the auxiliary top, the sensing mechanism can controllably relieve limiting fixation of the main top from the auxiliary top under a second state through induction control, the main top pops up under an elasticity action of the elastic part, and accordingly the main top and the auxiliary top rotate independently.

2. The combined type toy top separated through induction control according to claim 1, characterized in that the limiting fixation means that the main top rotates and is connected to the auxiliary top.

3. The combined type toy top separated through induction control according to claim 2, characterized in that the auxiliary top further comprises a connecting piece used to clamp and connect with the main top, in the second state, the sensing mechanism is triggered by induction to drive the connecting piece to rotate, and the main top relieves the clamping and connecting status after the rotation of the connecting piece.

4. The combined type toy top separated through induction control according to claim 3, characterized in that the sensing mechanism comprises an inductor inducting an outside inductive source, a motor driving the connecting piece to rotate and a power source supplying power for the motor; circuits of the motor and of the power source are interconnected when the inductor receives an induction from the outside inductive source, at the moment the motor works and drives the connecting piece to rotate, and further relives the clamping connection of the main top so that the main top pops up under the elasticity action of the elastic part, and accordingly the main top and the auxiliary top rotate independently.

5. The combined type toy top separated through induction control according to claim 4, characterized in that the inductor is an inductive switch electrically connected with the motor and the power source, the inductive switch is switched on when it receives the induction from the outside inductive source, the circuits of the motor and of the power source are interconnected, and the power source supplies power for the motor to make it work.

6. The combined type toy top separated through induction control according to claim 4, characterized in that the inductor is an inductive circuit connected with an electric control switch electrically connected with the motor and the power source, when the inductive circuit receives the induction from the outside inductive source, the inductive circuit sends a signal to switch on the electric control switch, the circuits of the motor and of the power source are interconnected, so that the power source supplies power for the motor to make it work.

7. The combined type toy top separated through induction control according to claim 6, characterized in that the inductive circuit and the circuits of the motor and of the power source are integrated on a circuit board, the circuit board is mounted at an edge-adjoining position inside the auxiliary top, the motor is mounted in a middle position inside the auxiliary top, and the power source is mounted aside the motor.

8. The combined type toy top separated through induction control according to claim 6, characterized in that the inductive circuit is a photosensitive inductive circuit, a magnetic control inductive circuit, a heat-sensitive inductive circuit or a sound control inductive circuit, the one or more different inductive circuits and the circuits of the motor and of the power source are integrated on the same circuit board, and when multiple inductive circuits are integrated on the circuit board, each of the inductive circuits may separately control the motor to work.

9. The combined type toy top separated through induction control according to claim 6, characterized in that the inductor is a magnetic control inductive circuit, and the magnetic control inductive circuit comprises an IC chip and a magnetic control switch, when the magnetic control switch receives a magnetic induction from the outside inductive source, the magnetic control switch is switched on to make the circuits be interconnected, and when it is detected that the magnetic control switch is switched on, the IC chip sends a control signal to control the motor to work.

10. The combined type toy top separated through induction control according to claim 4, characterized in that the inductor is a photosensitive inductor, a magnetic control inductor, a heat-sensitive inductor or a sound control inductor.

11. The combined type toy top separated through induction control according to claim 4, characterized in that the motor is arranged below the connecting piece in an accumbent manner, an end of a rotating shaft of the motor is connected with a toggle piece, when the motor is working, the rotating shaft rotates and drives the toggle piece to rotate, and the toggle piece rotates and drives the connecting piece to rotate to relieve the clamping connection of the main top.

12. The combined type toy top separated through induction control according to claim 11, characterized in that the toggle piece is a cylinder, either of two symmetrical sides of the cylinder is provided with a lug, a convex edge is disposed in a position, at a bottom edge of the connecting piece, corresponding to the toggle piece; driven by the rotating shaft of the motor, the lug of the toggle piece rotates to the convex edge of the connecting piece, and toggles the convex edge to drive the connecting piece to rotate to relieve the clamping connection of the main top.

13. The combined type toy top separated through induction control according to claim 11, characterized in that between the motor and the toggle piece there is provided with a planetary gear, one end of the planetary gear is connected with the rotating shaft of the motor, and the other end is connected with the toggle piece.

14. The combined type toy top separated through induction control according to claim 3, characterized in that the sensing mechanism is an inductive moving part that can move after being induced by an outside inductive source, the inductive moving part is clamped and connected with the connecting piece, after receiving the induction of the outside inductive source, the inductive moving part moves and relieves the clamping connection of the connecting piece to make the connecting piece move and relieve the clamping connection of the main top so that the main top pops up under the elasticity action of the elastic part, and accordingly the main top and the auxiliary top rotate independently.

15. The combined type toy top separated through induction control according to claim 1, characterized in that the limiting fixation means that a shotpin is inserted into the main top so that the main top is fixed above the auxiliary top.

16. The combined type toy top separated through induction control according to claim 15, characterized in that the auxiliary top further comprises a solenoid valve used to drive the shotpin to move, in the second state, the sensing mechanism is triggered by induction so that the solenoid valve drives the shotpin to move, and the main top relieves the limiting fixation after the shotpin moves.

17. The combined type toy top separated through induction control according to claim 1, characterized in that the auxiliary top is further provided with an automatic stop detection device, in the second state, when it is detected that the limiting fixation of the main top by the auxiliary top is relieved, the automatic stop detection device controls the sensing mechanism to disconnect the induction control.

18. The combined type toy top separated through induction control according to claim 1, characterized in that the elastic part is disposed in the auxiliary top, the elastic part comprises a spring and a pop-up seat, the spring is sleeved outside the connecting piece, the pop-up seat is mounted above the spring, when the main top is clamped and connected with the connecting piece, the spring and the pop-up seat are squeezed down, and when the main top is relieved from the clamping and connecting status after the connecting piece rotates, the pop-up seat moves up under the elasticity action of the spring, and meanwhile the main top is popped out.

19. The combined type toy top separated through induction control according to claim 18, characterized in that the auxiliary top comprises a top top and a top top holder, a lower top holder, an upper top holder, a top slice and a mounting base, the sensing mechanism is mounted and fixed inside the mounting base, the mounting base is fixed between the lower top holder and the upper top holder, the pop-up seat may be mounted, in a manner of moving up and down, between the upper top holder and the mounting base, the pop-up seat may move up to stretch out of the upper top holder and is limited by the upper top holder lest the pop-up seat should break away from the auxiliary top, and the top slice is sleeved between the upper top holder and the mounting base.

20. The combined type toy top separated through induction control according to claim 19, characterized in that an upper surface of the upper top holder is provided with a socket recess, a bottom of a top holder of the main top is correspondingly provided with a docking ring, a position of the docking ring corresponding to the socket recess is provided with a socket convex that mates with the socket recess, when the main top is clamped and connected with the auxiliary top, the socket convex of the docking ring is socketed into the socket recess of the upper top holder; in this way, it is implemented that driven by the motor, the connecting piece may rotate relative to the main top to relieve the clamping connection of the main top.

21. The combined type toy top separated through induction control according to claim 20, characterized in that the connecting piece may be rotatably mounted in the middle of the mounting base of the auxiliary top, a middle of the connecting piece is provided with a splined clamping and connecting hole, a side wall at an upper edge of the clamping and connecting hole is provided with an incised bevel edge, the connecting piece is provided with a return spring to make the connecting piece reverse to return after a rotation, a top top holder of the main top is correspondingly provided with a splined clamping lug; when the socket convex is aligned to the socket recess and a malposition exists between the clamping lug and the clamping and connecting hole, the main top is downward inserted into the auxiliary top, in this process, the clamping lug squeezes the incised bevel edge and generates a component force to make the connecting piece rotate so that the clamping lug is clamped into the clamping and connecting hole, after which, under the action of the return spring, the connecting piece reverses to return so that the clamping lug is clamped into the clamping and connecting hole, in this way, the main top and the auxiliary top are combined into a whole.

* * * * *